United States Patent [19]

Meola

[11] Patent Number: 4,490,953

[45] Date of Patent: Jan. 1, 1985

[54] DRYWALL CORNER BRACKET

[76] Inventor: Michael L. Meola, 626 Raritan Ave., Atco, N.J. 08004

[21] Appl. No.: 310,561

[22] Filed: Oct. 13, 1981

[51] Int. Cl.[3] ..... E06B 1/04

[52] U.S. Cl. ..... 52/211; 52/85; 52/371

[58] Field of Search ..... 52/211, 371, 85, 364, 52/367, 288, 287, 656

[56] References Cited

U.S. PATENT DOCUMENTS

| | | | |
|---|---|---|---|
| 1,674,439 | 6/1928 | Knapp | 52/364 |
| 1,979,701 | 11/1934 | Merryweather | 52/85 |
| 2,274,662 | 3/1942 | Briggs | 52/85 |
| 2,442,929 | 6/1948 | Marino | 52/85 |
| 2,663,390 | 12/1953 | Dordel | 52/211 |
| 2,821,754 | 2/1958 | Hillson | 52/288 |
| 2,854,843 | 10/1958 | Lamb | 52/371 |
| 3,451,178 | 6/1969 | Beale | 52/288 |

*Primary Examiner*—Henry E. Raduazo

*Attorney, Agent, or Firm*—Eugene Chovanes

[57] ABSTRACT

A metal corner bracket for use in drywall construction in corners on windows and archways to eliminate subsequent cracking at the corners.

2 Claims, 9 Drawing Figures

DRYWALL CORNER BRACKET

BACKGROUND OF THE INVENTION

In building construction, including residential, commercial and industrial, an archway or window opening normally has a horizontally extending top structural member called a "header", and vertically extending members framing the opening called "jacks" or "legs." The arch is then often paneled with drywall, with edge beading applied to the edges of the arch opening. Where the jacks and headers are in perfect alignment, the edging provides for a perfect corner finish.

Generally, however, the headers and jacks are somewhat twisted or offset with respect to one another to some degree during installation. When this happens, the header and jacks are not square with respect to one another and are not in the same face plane on the wall side, so that when the wall around the archway is paneled with drywall, an irregularity, or imperfection, occurs at the corner of the archway. To remedy this imperfection, a relatively thick coating of drywall compound or plaster is applied to fill in the imperfection. Cracks often subsequently develop in the plaster at the corner, either from movement of the jacks and headers with respect to one another from, for instance, shrinkage or from drying out of the plaster.

SUMMARY OF THE PRESENT INVENTION

Even when the jack or the header is out of alignment or twisted, one with respect to the other, the corner bracket of the invention provides an element which results in a perfect corner being created. The bracket eliminates the need for any mass of plaster. The corner bracket of the invention is in the form of a right angle and is flexible in that it can twist or otherwise be formed to compensate for the irregularity in the arch construction. The bracket cooperates with the prior art edge beading to yield a continuous and smooth surface. The normal drywall procedure can be followed in that drywall tape and compound can be applied, yielding a perfect corner which does not subsequently crack.

DETAILED DESCRIPTION OF THE ILLUSTRATIVE EMBODIMENT

Figure 1:
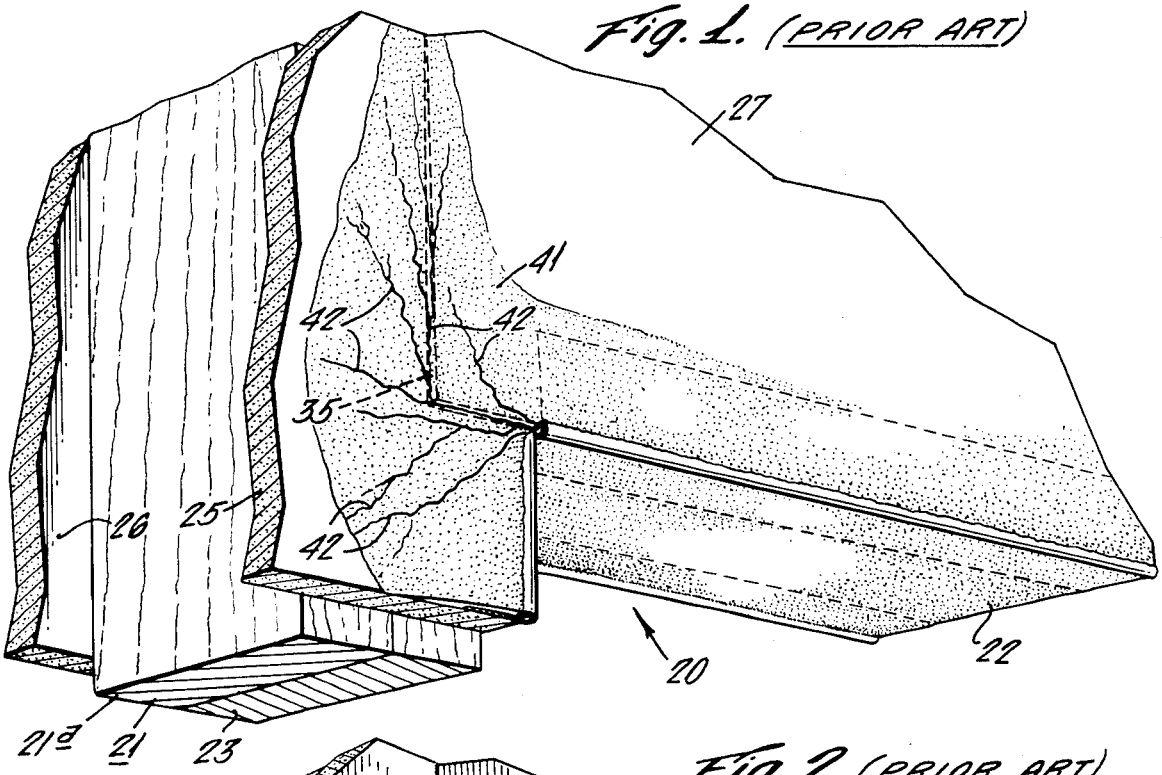
Fig. 1. (PRIOR ART)
FIG. 1 is a perspective view of a prior art corner of an archway, showing the cracks that are likely to develop.
Figure 2:
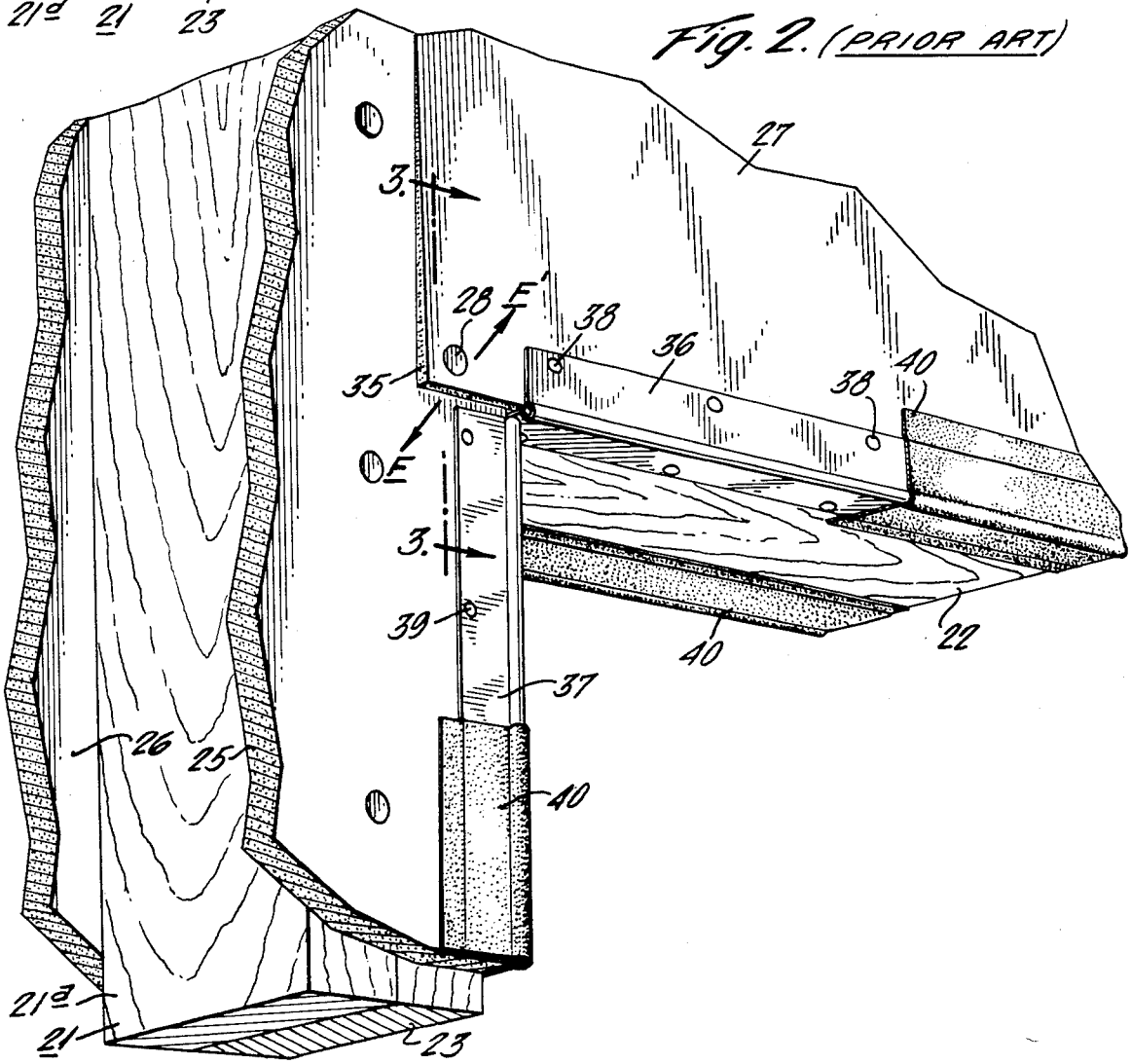
Fig. 2. (PRIOR ART)
FIG. 2 is a pictorial perspective view of the same arch as FIG. 1, showing the conventional archway using conventional drywall construction methods, but with the plaster and paint and the coatings removed for clarity in the drawing, wherein the header edge strip and the jack edge strip are displaced from a perfect mating arrangement, due to movement or displacement of the jack relative to the header.
Figure 3:
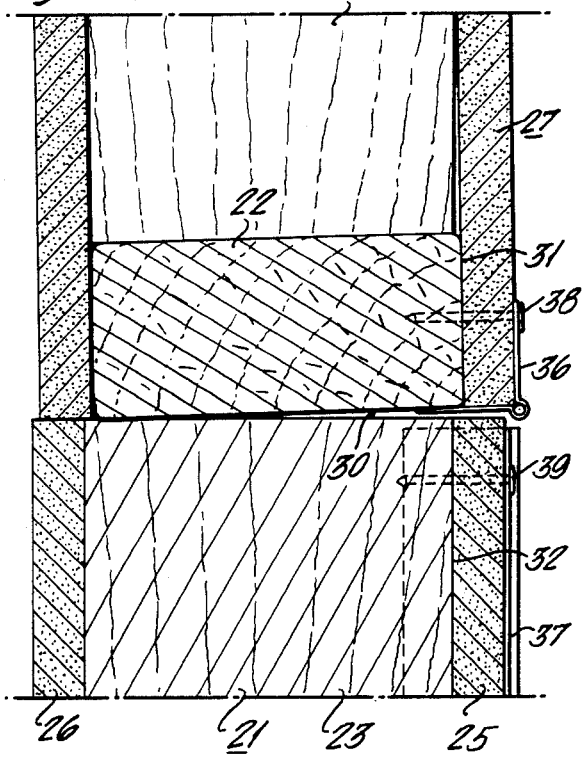
Fig. 3. (PRIOR ART)
FIG. 3 is a fragmentary sectional view on an enlarged scale taken on the line 3—3 of FIG. 2.

There is shown in FIGS. 1 to 3 a prior art arch opening 20 having a vertically extending jack 21 and a horizontally extending header 21*a*. Jack 21 is shown formed of wooden members 22 and 23 fastened together as by nailing to form a firm vertical member. Header 22, which likewise can be formed of a horizontal wooden member is suitably fastened to jack 21, as by nailing. Drywall paneling 25 and 26 is fastened, as by nailing or adhesively, to the face of the wall in which arch 20 is formed.

Wall 26 is formed of a plurality of panels which are abutted in well known fashion and suitably secured to the wall structural members. In such manner drywall panel 27 abuts drywall panel 25 around arch opening 20. Panel 25 is secured to jack 21 and panel 27 is secured to header 22 as for instance by nail 28.

Generally, header 22 and jack 21 are twisted or offset with respect to one another because of, for instance, shrinkage in the wood members or general inability for the installer to perfectly align the members because of irregular cuts or the like. Such offset is shown clearly in FIGS. 3 and 6 where header 22 is misaligned with jack 21, resulting in gap 30. Face 31 of header 22 extends slightly beyond face 32 of jack 21. Panels 27 and 25 are applied to jack 21 and header 22 respectively. A gap or irregularity is then created at 35 as seen in FIG. 2.

Edge beads 36 and 37 are then applied to the header 22 and jack 21, over panels 27 and 25, in the prior art manner as by nailing at 38 and 39. Tape 40 is then applied over the edge bead. A finished coating of drywall compound or plaster 41 is then applied to compensate for the gap or irregularity 35 at the inside corner of arch 20, as well as to smooth out the edges around the tape 40. Such procedure for drywalling is well known.

After the archway or window opening is completed as described above, through settling of the structure, or, through stresses generally imparted to the walls, opposing forces F and F′ are created at the corner as seen in FIG. 2. Such stresses result in slight movement of the jack 21 and header 22, as well as panel 26 and 27, with respect to one another. Since the drywall compound or plaster 41 is rigid and unyielding, unsightly stress cracks 42 develop at the corner. Also, shrinkage of the plaster itself may cause cracks. Such damage at the corner of the archway or opening is highly undesirable and results in subsequent complaints and repair.

Figure 8:
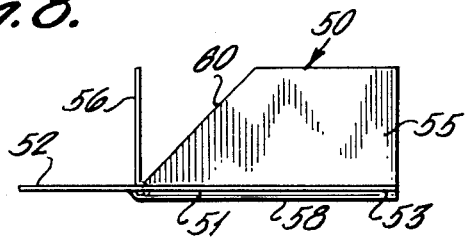
FIG. 8 is a top plan view of the bracket of FIG. 7.
Figure 7:
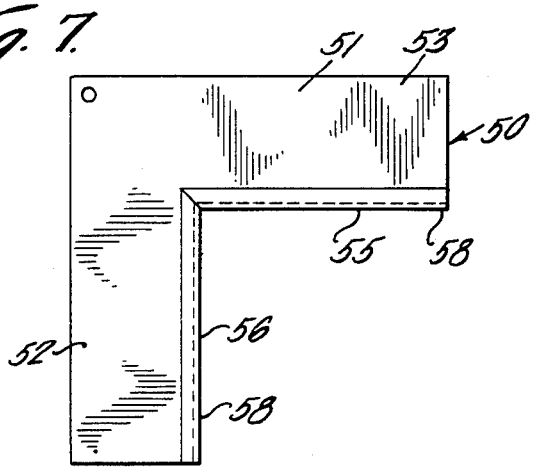
FIG. 7 is a front elevational view of the bracket of the invention.
Figure 9:
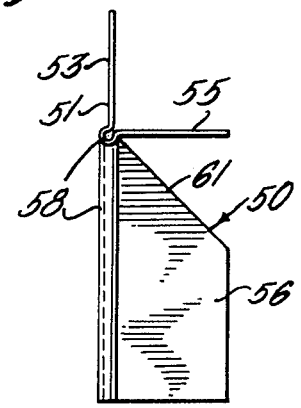
FIG. 9 is a right side elevational view of the bracket of FIG. 7.

In the present invention, a corner bracket 50 as seen in FIGS. 7, 8 and 9 has a face portion 51 having a right angle configuration with legs 52 and 53. Extending from face 51 is a first portion 55 at a right angle to face portion 51 and connected to leg 53. A second portion 56 extends at a right angle to face 51 from leg 52. A bead 58 extends around the inside edge of the bracket.

Portion 55 has a suitably beveled or diagonal edge 60 and portion 56 has a diagonal or beveled edge 61.

Figure 6:
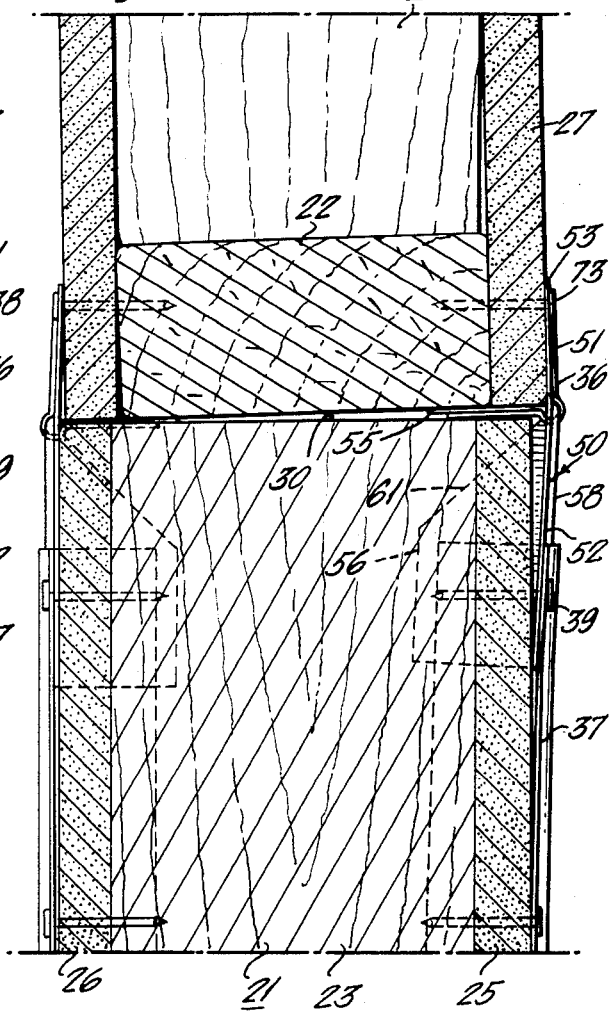
FIG. 6 is a sectional view similar to FIG. 3 taken on the line 6—6 of FIG. 5.
Figure 4:
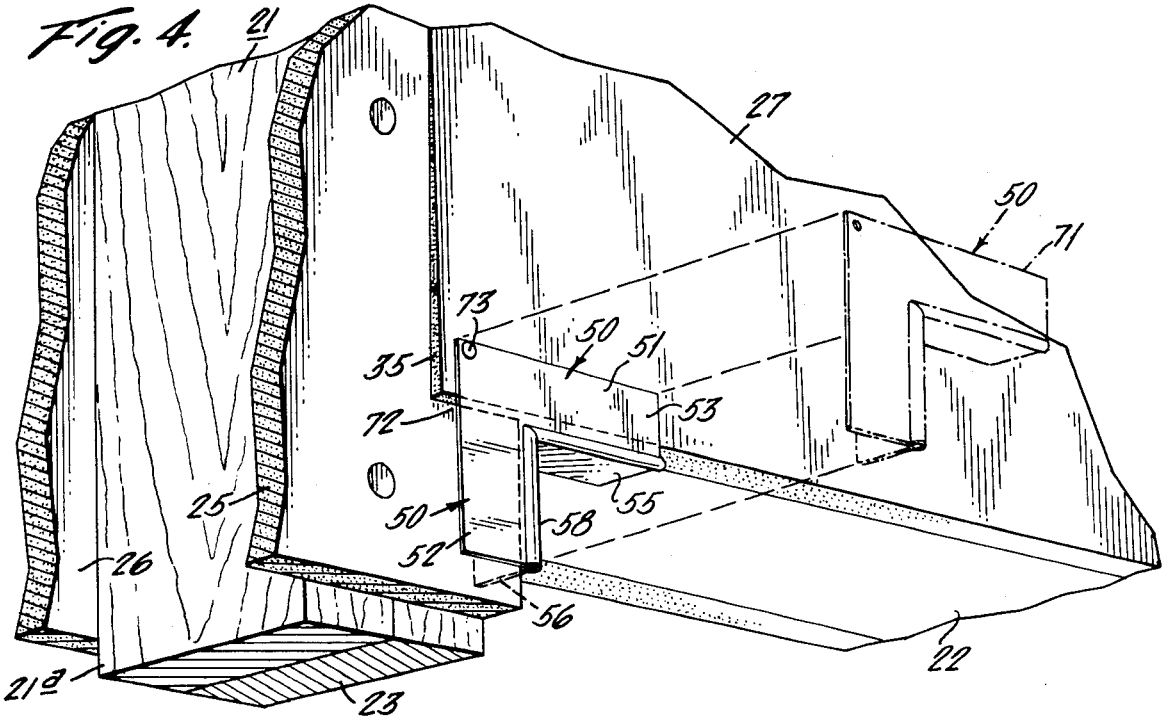
FIG. 4 is a perspective view of an archway having the same imperfections as represented in FIGS. 1 through 3, and having all the drywall construction for finishing the archway removed, with the corner bracket of the invention applied.
Figure 5:
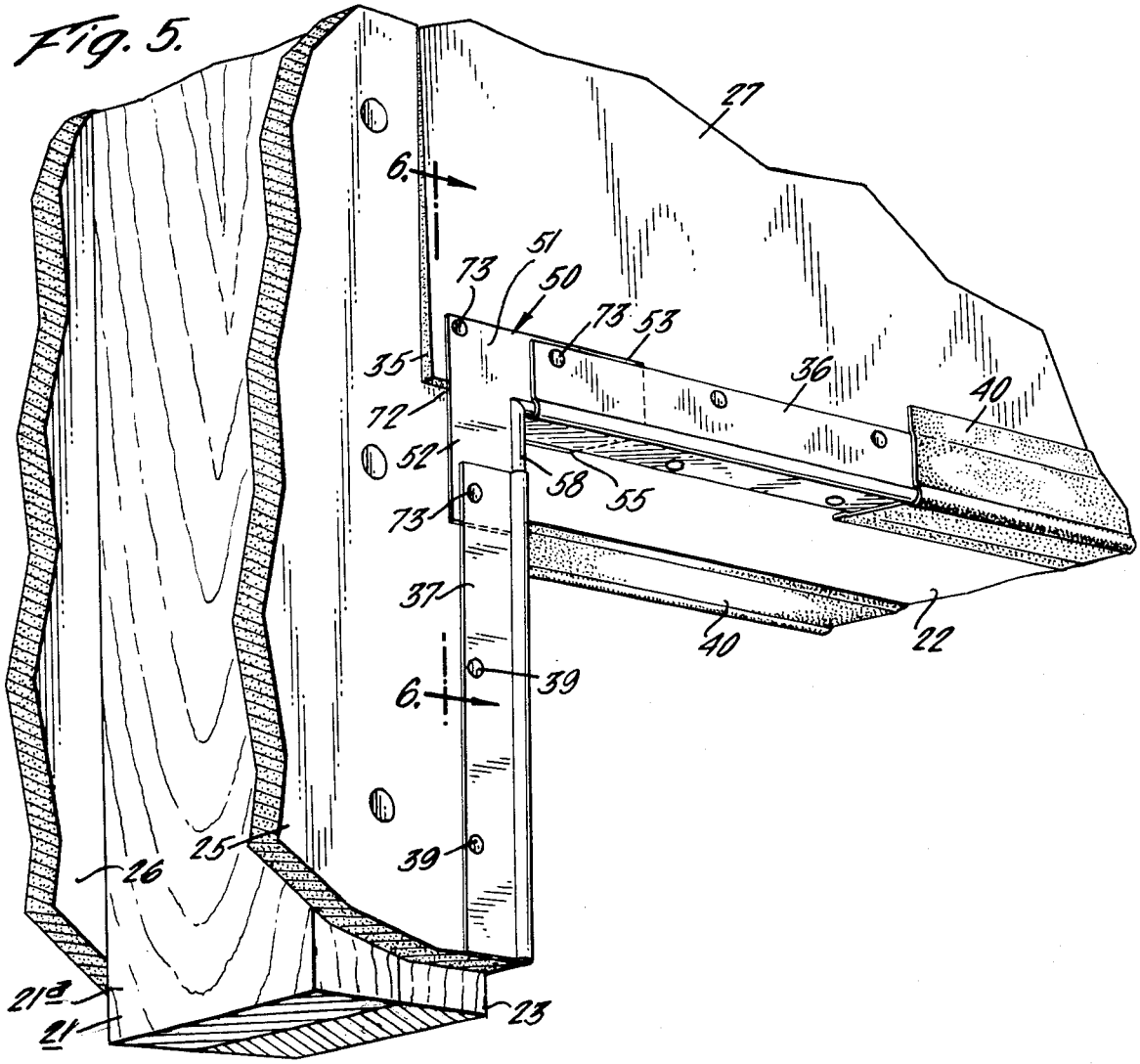
FIG. 5 is a further perspective view of the arch of FIG. 4 showing the edge beading applied and a portion of the drywall tape applied.

Bracket 50 is installed as seen in FIGS. 4, 5 and 6 in the construction of the archway. Bracket 50 is inserted from a position as seen in FIG. 4 at 71 into the inside corner at 72, after the drywall has been applied but before edge beading 37 is applied.

Bracket 50 is formed integrally of extremely thin sheet metal of the same or similar gauge as prior art edge beading 37.

The bracket construction permits the bracket to flex and conform to the irregularity in the joint at the corner as seen best in FIG. 6. Suitable nails 73 are driven through the bracket 50 and edge beads 36 and 37 to affix the bracket and beading to the archway as shown in the Figures. The edges of the bracket, or portions 55 and 56 conform to the header and jack respectively while face 51 lies over panels 25 and 27. Drywall tape 40 is subsequently applied over the edge beading 37 and corner bracket 50 in the prior art manner, and a subsequent thin layer of finishing plaster, again in the well known prior art manner, is formed over the tape and drywall panels. The bracket of the invention 50 provides a perfect corner whether the jacks or beads are twisted or offset with respect to one another. The bracket binds the header with the jacks so that in the event of movement, the header and jack will move together, eliminating the separate movement which causes cracking. Thus the invention insures a perfect corner for looks and construction.

In view of my invention and disclosure, variations and modifications to meet individual whim or particular need will doubtless become evident to others skilled in the art, to obtain all or part of the benefits of my invention without copying the structure shown, and I therefore claim all such insofar as they fall within the reasonable spirit and scope of my claims.

Having thus described my invention, what I claim as new and desire to secure by Letters Patent is:

1. A bracket formed from a flat blank of metal for a corner of an arch formed by a jack and a header having thereon drywall panels affixed to the jack and header comprising:

(a) a face portion having first and second coplanar legs extending at right angles to one another;

(b) a first portion extending in a plane normal to the face portion and to the first leg; and (c) a second portion extending in a plane normal to the second leg;

(d) said first portion and said second portion being integral with said face portion but formed by cutting and bending of the blank intermediate said first and second legs;

wherein the first leg and the first portion are affixed to the header, and the second leg and the second portion are affixed to the jack.

2. A bracket of claim 1 having a bead portion extending along the edge connecting the face portion with the first and second portions.

* * * * *